US006355103B1

(12) United States Patent
Inaba et al.

(10) Patent No.: US 6,355,103 B1
(45) Date of Patent: Mar. 12, 2002

(54) COATING MASK DEVICE FOR LIGHTING DEVICE

(75) Inventors: Keiichi Inaba; Kiyoshi Yazaki, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/343,203

(22) Filed: Jun. 30, 1999

(30) Foreign Application Priority Data

Jun. 30, 1998 (JP) ..... 10-183521

(51) Int. Cl.[7] ..... B05B 15/04; B05C 11/00
(52) U.S. Cl. ..... 118/504; 118/301; 118/213
(58) Field of Search ..... 118/504, 505, 118/301, 213; 427/468, 300

(56) References Cited

U.S. PATENT DOCUMENTS 3,221,648 A * 12/1965 Weiss ..... 101/129
5,937,752 A * 8/1999 Uchiyama ..... 101/127.1

* cited by examiner

*Primary Examiner*—Richard Crispino
*Assistant Examiner*—Kevin P. Shortsle
(74) *Attorney, Agent, or Firm*—Sughrue Mion, PLLC

(57) ABSTRACT

A coating mask device for a lighting device in which a mask body is divided into a plurality of sections so that the mask body can be easily handled. The coating mask device for a lighting device includes a support jig 10, on which a component part 14 of the lighting device can be placed, and a mask body 20 having an opening 22 corresponding to a coat-forming region 15 of the lighting device component part 14. The mask body 20 is divided into a partial mask 21, having the opening 22, and a main mask 23 for covering that region of the component part other than that region covered by the partial mask 21. The partial mask 21 is removable from the main mask 23. The whole of the mask body 20 does not need to be exchanged, and it is only necessary to exchange the partial mask 21 which is compact and light-weight.

8 Claims, 6 Drawing Sheets

COATING MASK DEVICE FOR LIGHTING DEVICE

BACKGROUND OF THE INVENTION

1. Field of the Invention

This invention relates to a coating mask device used for applying a coating only to a desired portion of a molded product serving as a component part of a lighting device for a vehicle.

2. Related Art

In a conventional coating mask device of this type shown in FIGS. 9 and 10, a support jig 2, on which a lens 3 (which is a component part of a lighting device) can be placed, is supported on a support base 1; and a mask body 4 is provided so as to cover the lens 3 placed on the support jig 2. An opening 4*a* is formed through that portion of the mask body 4 corresponding to a coat-forming region 3*a* of the lens 3. A spray coating is applied from the upper side of the opening 4*a* (as indicated by broken lines in FIG. 9), thereby applying a coating only to the desired portion (i.e., the coat-forming region 3*a*) of the lens 3.

The mask body 4 is integrally formed with an upper frame 5, and can be pivotally moved about a horizontal axis 1*a* disposed at the support base 1. The mask body 4 can be opened and closed relative to the jig 2 as shown in FIG. 10, and with this construction the lens 3 can be placed on and removed from the support jig 2. The upper frame 5 can be retained relative to the support base 1 by a hook 6.

The upper frame 5, having the mask body 4 integrally formed therewith, can be removed from the support base 1 at the horizontal axis 1*a*. Three upper frames 5 of the same specification, each having the mask body 4 integrally formed therewith, are prepared beforehand. The mask body 4 (and hence the upper frame 5), which has been stained after long use in the coating process, is removed from the support base 1 for cleaning purposes, and a new mask body 4 (and new upper frame 5) of the identical specification and kept in store, is mounted on the support base 1, and is used.

Namely, when the mask body 4 is used for a long period of time, a thick coating layer is deposited on the peripheral edge portion of the opening 4*a,* and this can prevent proper coating. Therefore, each time a predetermined number of (for example, one hundred) products are coated, the mask body 4 (and the upper frame 5) is replaced by a new one.

In the above conventional coating mask device, however, even if the coat-forming region 3*a* is one portion of the component part of the lighting device, the mask body 4 is formed into such a size as to cover the whole of the lighting device component part, and, therefore, the following problems have been encountered.

First, since the mask body 4 has a large size, extensive time is required for forming the mask body 4, and the cost increases.

Second, since the mask body 4 has a large size, it is heavy and can not be easily handled.

Third, generally, for cleaning the mask body 4 (and hence the upper frame 5), several mask bodies 4 are put into a cleaning cage, and then this cage is dipped in a cleaning liquid in which ultrasonic cleaning is effected. However, since the mask body 4 has a large size, the number of the mask bodies which can be put into the cage is limited, and the efficiency of the cleaning operation is poor. Moreover, a large amount of cleaning liquid is required.

Fourth, since the mask body 4 has a large size, a large space is required for storing the other two mask bodies (and the upper frames) not yet used.

Fifth, when the design or configuration of the lighting device component part is changed, all of the three mask bodies 4 must be modified which is inefficient and expensive.

SUMMARY OF THE INVENTION

With the above problems in mind, it is an object of this invention to provide a coating mask device for a lighting device in which a mask body is divided into a plurality of sections so that the mask body can be easily handled.

According to the present invention, there is provided a coating mask device for a lighting device comprising a support jig, on which a component part of the lighting device can be placed, and a mask body arranged so as to cover the lighting device component part placed on the support jig, the mask body having an opening corresponding to a coat-forming region of the lighting device component part; wherein the mask body is divided into a partial mask having the opening, and a main mask for covering that region of the component part other than that region covered by the partial mask; and wherein the partial mask is removable from the main mask.

For example, three partial exchangeable masks are prepared for one main mask. Each partial mask, having the opening corresponding to the coat-forming region of the lighting device component part, is smaller in size than the mask body, and, therefore, can be processed. The partial mask is compact and lightweight, and, therefore, can be easily handled. Moreover, the required storage space is small, and many partial masks can be put into a cleaning cage at a time. Therefore, the efficiency of the cleaning operation is high, and the amount of a cleaning liquid required is small. Furthermore, if a portion of the lighting device component part, corresponding to the main mask, is changed in configuration, it is only necessary to modify the main mask, and the partial mask does not need to be modified.

According to an embodiment of the present invention, the partial mask and the main mask overlap each other at their joining portions at which the two masks are joined together, thereby preventing coating material from being applied to a region other than the coat-forming region of the lighting device component part.

According to another embodiment of the present invention, the support jig is supported on a support base, and each of the partial mask and the main mask is pivotally movable upwardly and downwardly about a respective horizontal axis disposed at the support base so as to be opened and closed relative to the support jig, and the partial mask is disposed near the horizontal axis of pivotal movement of the main mask.

When the partial mask,.having the opening corresponding to the coat-forming region of the lighting device component part, is disposed near the horizontal axis of pivotal movement of the main mask, an error in the positioning of the opening relative to the coat-forming region of the component part is smaller when compared to the case where the partial mask is disposed remote from the horizontal axis.

According to yet another embodiment of the present invention, the horizontal axis of pivotal movement of the partial mask and the horizontal axis of pivotal movement of the main mask are the same.

It is preferred that the horizontal axis of pivotal movement of the partial mask should be disposed at the predetermined position close to the horizontal axis of pivotal movement of the main mask in such a manner that the partial mask will not interfere with the support jig. If the horizontal axis of pivotal movement of the partial mask and the horizontal axis of pivotal movement of the main mask are the same, an error in the positioning of the opening is further reduced, and the two masks can be easily designed.

DESCRIPTION OF THE PREFERRED EMBODIMENTS OF THE INVENTION

A preferred embodiment of the present invention will now be described.

Figure 1:
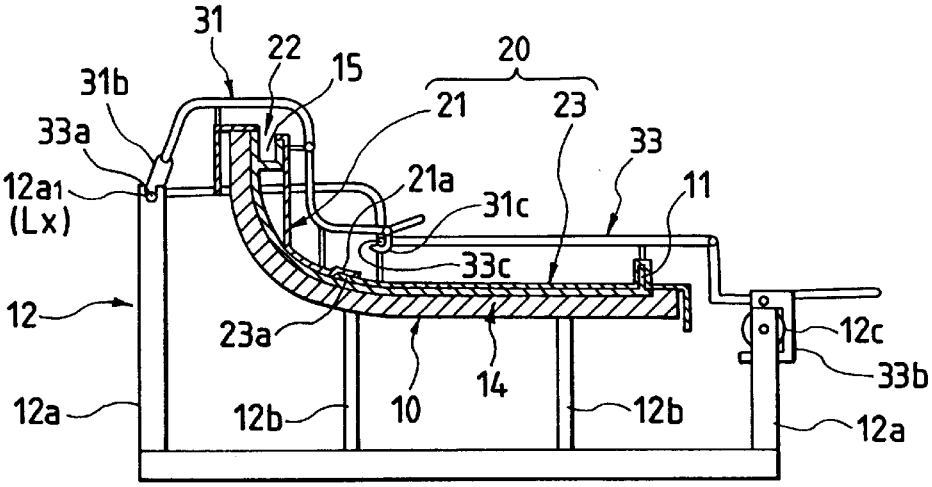
FIG. 1 is a vertical cross-sectional view showing the overall construction of a first embodiment of a coating mask device of the invention for a lighting device.
Figure 2:
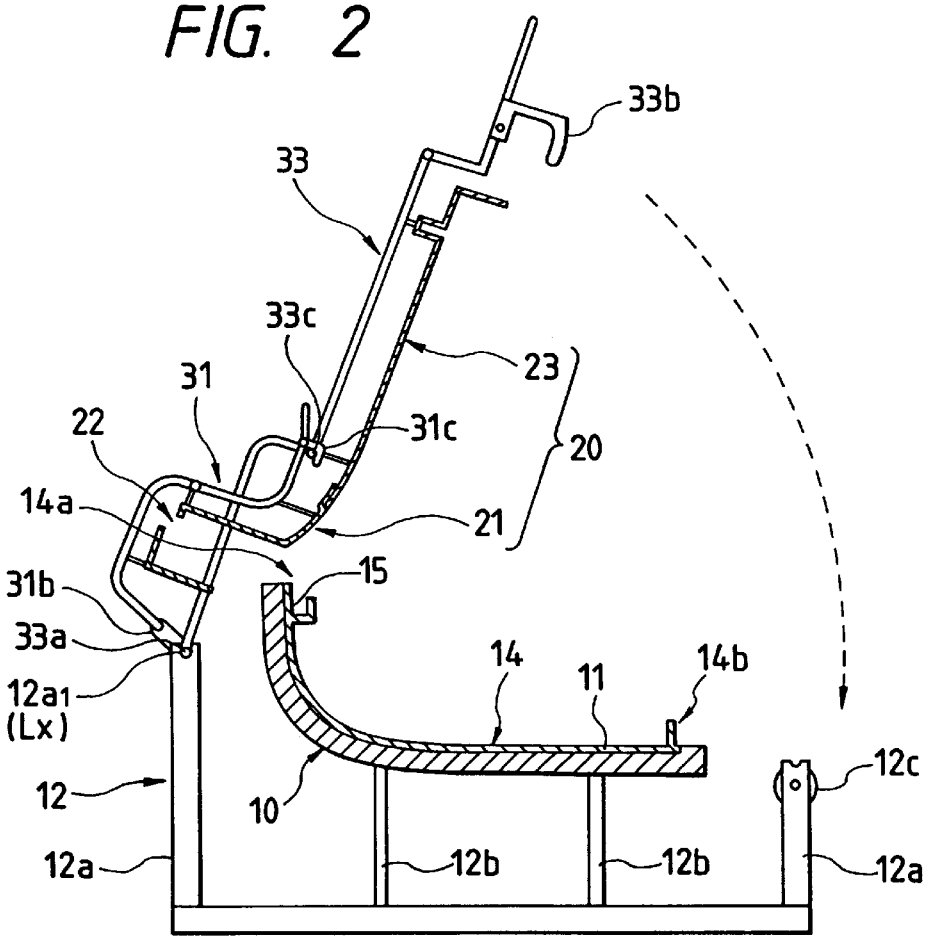
FIG. 2 is a vertical cross-sectional view of the coating mask device, showing a mask body in its open condition.
Figure 3:
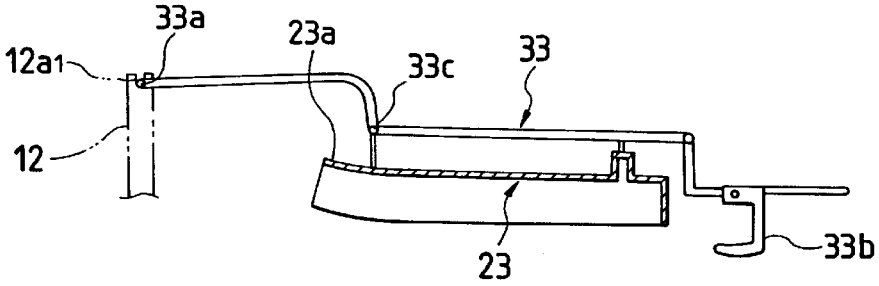
FIG. 3 is a vertical cross-sectional view of a main mask of the coating mask device.
Figure 4:
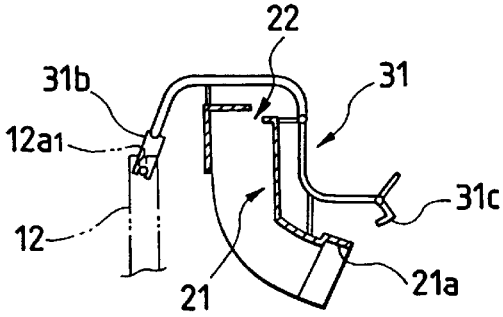
FIG. 4 is a vertical cross-sectional view of a partial mask of the coating mask device.
Figure 5:
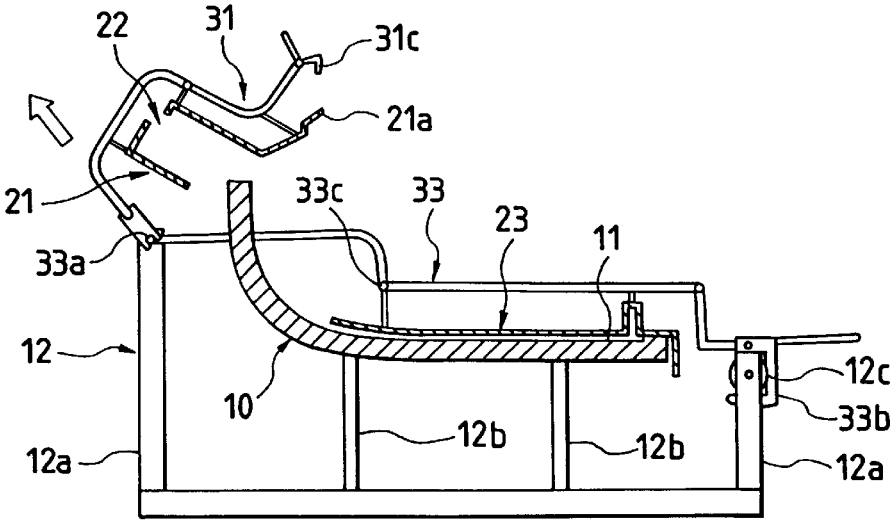
FIG. 5 is a vertical cross-sectional view of the coating mask device showing the manner of removing the partial mask.
Figure 6:
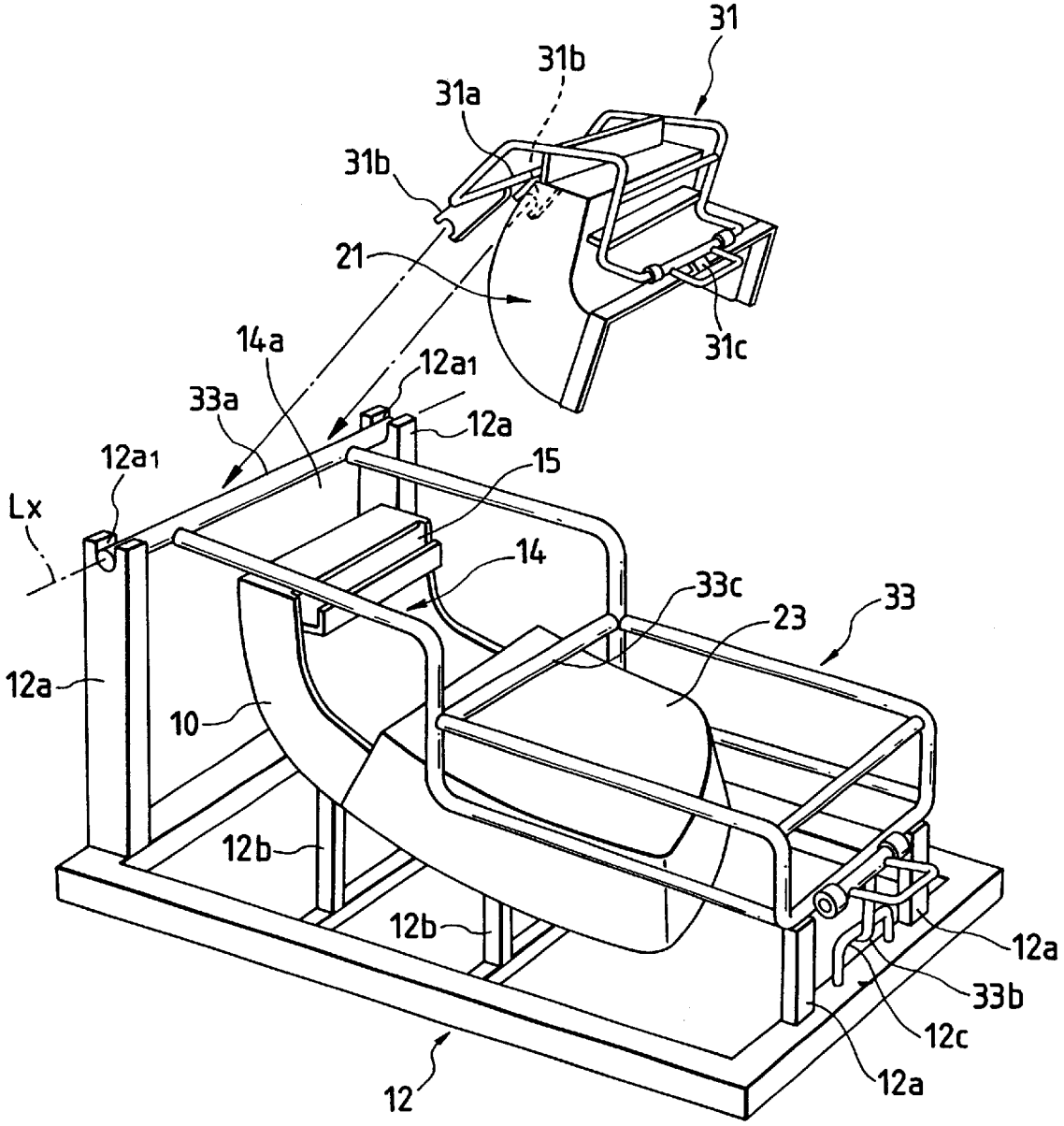
FIG. 6 is a perspective view of the coating mask device.

FIGS. 1 to 6 show a first embodiment of a coating mask device of the invention for a lighting device. FIG. 1 is a vertical cross-sectional view showing the overall construction of the coating mask device of the first embodiment, FIG. 2 is a vertical cross-sectional view of the coating mask device showing a mask body in its open condition, FIG. 3 is a vertical cross-sectional view of a main mask of the coating mask device, FIG. 4 is a vertical cross-sectional view of a partial mask of the coating mask device, FIG. 5 is a vertical cross-sectional view of the coating mask device showing the manner of removing the partial mask, and FIG. 6 is a perspective view of the coating mask device.

In these Figures, a support jig 10, on which a lens 14 of a synthetic resin (which is a component part of the lighting device) can be placed, is supported on a frame-like support base 12 having a rectangular shape when viewed from the top. Two pairs of support posts 12*a,* which support the mask body 20 (described later), are formed upright respectively at front and rear ends (right and left ends in FIG. 1) of the support base 12. Four support posts 12*b,* which support the support jig 10, are formed upright at a generally central portion of the support base 12 in the forward-rearward direction.

The support jig 10 is formed into a curved configuration corresponding to the outer shape of the curved lens 14, and a recess 11, having a shape corresponding to the outer shape of the lens 14, is formed in the upper surface of the support jig 10. When the lens 14 is placed on this recessed portion 11, the lens 14 is held in this condition in such a manner that a coat-forming region 15, formed on the reverse side of the lens 14, is directed upwardly.

The mask body 20 has such a size as to cover the whole of the lens 14 from the upper side, and an opening 22 is formed through that portion of the mask body corresponding to the coat-forming region 15 of the lens 14. The mask body 20 is divided into the partial mask 21 for covering a curved end portion 14*a* of the lens 14 and the main mask 23 for covering the remainder of the lens 14 including the other end 14*b* thereof. The partial mask 21 and the main mask 23 cooperate with each other to form the mask body 20, and the two masks 21 and 23 overlap each other at their end portions (joining portions) 21*a* and 23*a* so that a gap will not be formed in a mask-extending direction (right-left direction in FIG. 1) between the joining portions of the two masks 21 and 23.

The main mask 23 is integrally formed with an upper main frame 33 which can be pivotally moved about a horizontal axis extending through the pair of opposed support posts 12*a* and 12*a* provided at the rear end of the support base 12. Therefore, the main mask 23 can be pivotally moved together with the upper main frame 33. More specifically, the upper main frame 33 has a rectangular shape when viewed from the top, and a horizontal pipe 33*a,* provided at one end of the upper main frame 33, is engaged in U-shaped grooves 12*a*1 formed respectively in the support posts 12*a* of the support base 12. With this construction, the upper main frame 33 (and hence the main mask 23) can be pivotally moved about the horizontal axis Lx. A hook 33*b* is formed at the other end of the upper main frame 33. By engaging this hook 33*b* with a retaining portion 12*c* provided at the support base 12, the main mask 23 can be held in a closed condition.

The partial mask 21 is integrally formed with an upper partial frame 31 which can be pivotally moved about the horizontal axis Lx, and the partial mask 21 can be pivotally moved together with the upper partial frame 31. More specifically, the upper partial frame 31 is smaller in width than the upper main frame 33, and has a rectangular shape when viewed from the top. Bifurcated extension portions 31*b* extend from a horizontal pipe 31*a* provided at one end of the upper partial frame 31. By engaging these bifurcated extension portions 31*b* with the horizontal pipe 33*a* of the upper main frame 33, the upper partial frame 31 (and hence the partial mask 21) can be pivotally moved about the axis of the horizontal pipe 33*a* of the upper main frame 33 (that is, the horizontal axis Lx).

A hook 31*c* is formed at the other end of the upper partial frame 31, and by engaging this hook 31*c* with a hook retaining portion 33*c* of the upper main frame 33, the upper partial frame 31 can be integrally connected to the upper main frame 33 so that the upper partial frame 31 can be pivotally moved together with the upper main frame 33. When the upper partial frame 31 is thus integrally-connected to the upper main frame 33, the stepped end portion (joining portion) 21*a* of the partial mask 21 is superposed on the joining portion 23*a* of the main mask 23.

By disengaging the bifurcated extension portions 31*b* of the upper partial frame 31 from the horizontal pipe 33*a* of the upper main frame 33, the upper partial frame 31 (and hence the partial mask 21) can be easily disconnected from the upper main frame 33 (and hence the main mask).

Next, an operation in which a coating is applied to part of the lens by the use of this coating mask device, as well as an operation in which the stained upper partial frame 31 (and the partial mask 21) is removed and replaced by a new one, will be described.

The upper partial frame 31 can be integrally connected to the upper main frame 33 so as to be pivotally moved with this upper main frame 33. Namely, the partial mask 21 and the main mask 23 are integrally connected together. The upper main frame 33 is moved upwardly as shown in FIG. 2, and in this condition the lens 14 is placed on and fixed to the support jig 10. Next, the upper main frame 33 (and the mask body 20) is closed as shown in FIG. 1, and the hook 33*b* is engaged with the hook retaining portion 12*c*. Next, a spray coating is applied to the interior of the mask from the upper side of the opening 22 so that a coating layer is formed only on the coat-forming region 15 on the reverse side of the lens 14. When this coating operation is finished, the hook 33*b* is disengaged from the hook retaining portion 12*c*, and the upper partial frame 31 and the upper main frame 33 is moved upwardly as shown in FIG. 2. In this condition the lens 14 is removed, and then another lens 14 is placed on and fixed to the support jig 10 and the above operation is effected. By repeating this operation, the coating can be applied to a required number of lenses 14.

Many lenses 14 are thus subjected to the coating treatment, and when the coating material is deposited on the peripheral edge portion of the opening 22 in the mask to narrow the opening 22 so that the coating can not be properly effected, the hook 31*c* is disengaged from the hook retaining portion 33*c*, and the stained upper partial frame 31 (and the partial mask 21) is moved upwardly relative to the upper main frame 33 (and the main mask 23) as shown in FIG. 5. Then, the stained upper partial frame 31 (and the partial mask 21) is removed, and a new upper partial frame 31 (and a new partial mask 21) is attached to the upper main frame 33 (and the main mask 21). A predetermined number of the removed upper partial frames 31 (and the partial masks 21) are put into a cleaning cage, and this cage is dipped in a cleaning liquid so that stains are removed from these upper partial frames (and these partial masks) by ultrasonic cleaning. The cleaned upper partial frames and partial masks are then stored at in predetermined place.

The partial mask 21 is smaller in size and weight than the mask body 20, and, therefore, it can be easily handled in the coating process and the cleaning process. Also the required storage space for the partial mask is small.

In the cleaning process, many partial masks can be put into the cleaning cage at one time, and, therefore, the efficiency of the cleaning operation is high, and the amount of the cleaning liquid required is small.

In this embodiment, the partial mask 21 is disposed near the horizontal axis Lx (the axis of pivotal movement of the main mask 23). Therefore, as compared with the case where the partial mask 21 is disposed remote from the horizontal axis Lx (the axis of pivotal movement of the main mask 23), the opening 22 in the mask can be more accurately positioned relative to the coat-forming region 15 of the lens 14. Therefore, the coating can be accurately applied to the predetermined portion of the lens.

Figure 7:
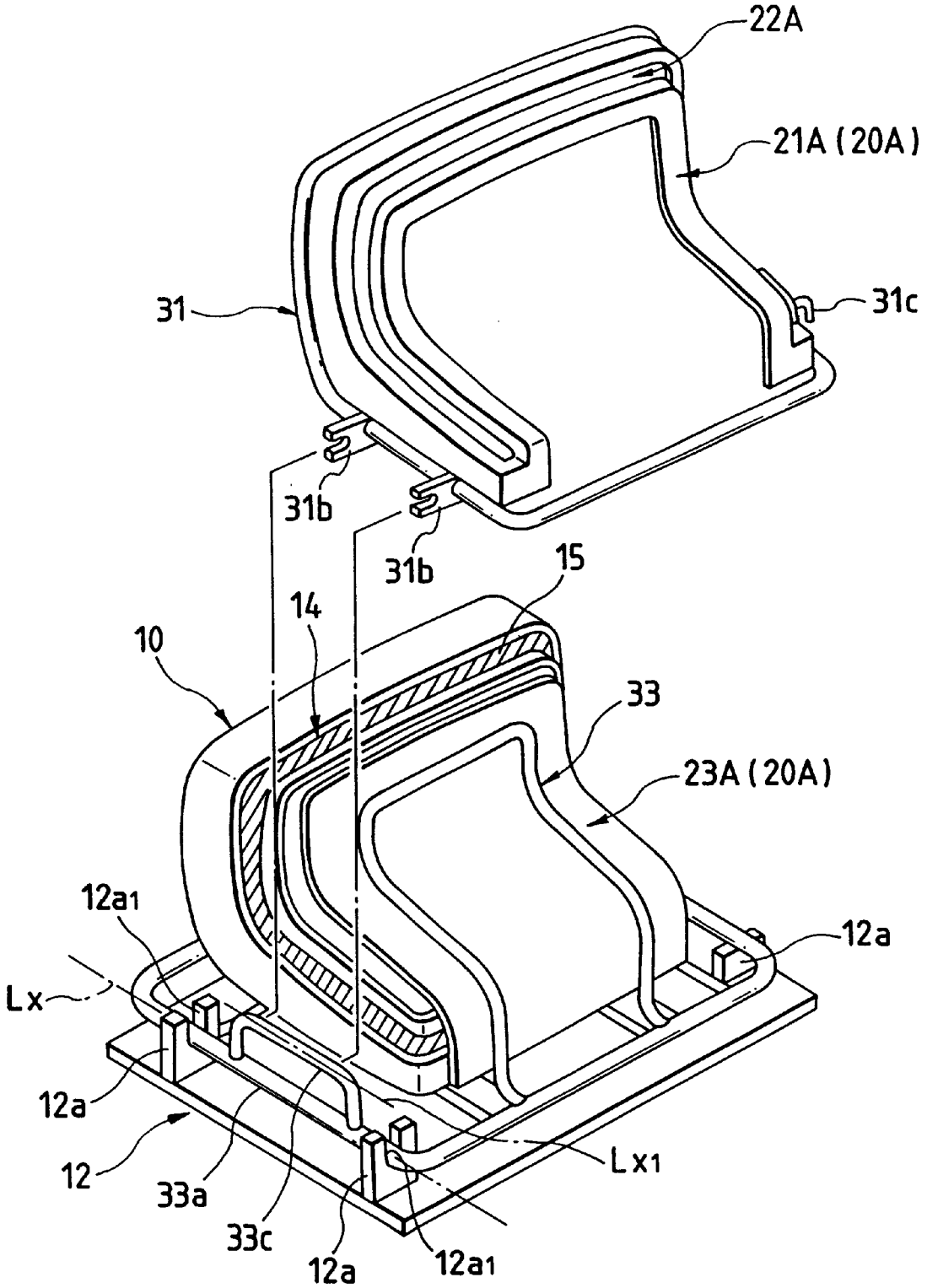
FIG. 7 is a vertical cross-sectional view of a second embodiment of a coating mask device of the invention for a lighting device.

FIG. 7 is a perspective view of a second embodiment of a coating mask device of the invention for a lighting device.

In the coating mask device of the first embodiment, the coating is applied to one end portion of the lens 14 at the reverse side thereof. However, in this second embodiment, a coating is applied to an outer peripheral portion of a reverse side of a lens disposed outwardly of a seal leg thereof.

Namely, in the preceding embodiment, the mask body 20 is divided into the partial mask 21, which has the opening 22 (corresponding to the coat-forming region 15), and can cover the one end portion of the lens 14, and the main mask 23 for covering the remainder of the lens 14. In this second embodiment, however, a mask body 20A is divided into a partial mask 21A, which has an opening 22A (corresponding to a coat-forming region 15 (indicated by hatching in FIG. 7) which is an outer peripheral portion of the reverse side of the lens 14), and a main mask 23A for entirely covering that region of the lens disposed inwardly of that region covered by the partial mask 21A. A U-shaped horizontal pipe 33*c* extends upwardly from a horizontal pipe 33*a*, forming a horizontal axis Lx about which an upper main frame 33 can be pivotally moved. Bifurcated extension portions 31*b* of an upper partial frame 31 are engaged with the horizontal pipe 33*c*, and a horizontal axis Lx1, about which the upper partial frame 31 (and hence the partial mask 21A) can be pivotally moved, is disposed above the horizontal axis Lx.

The other construction of this embodiment is identical to that of the first embodiment, and these portions will be designated by identical reference numerals, respectively, and explanation thereof will be omitted.

Figure 8:
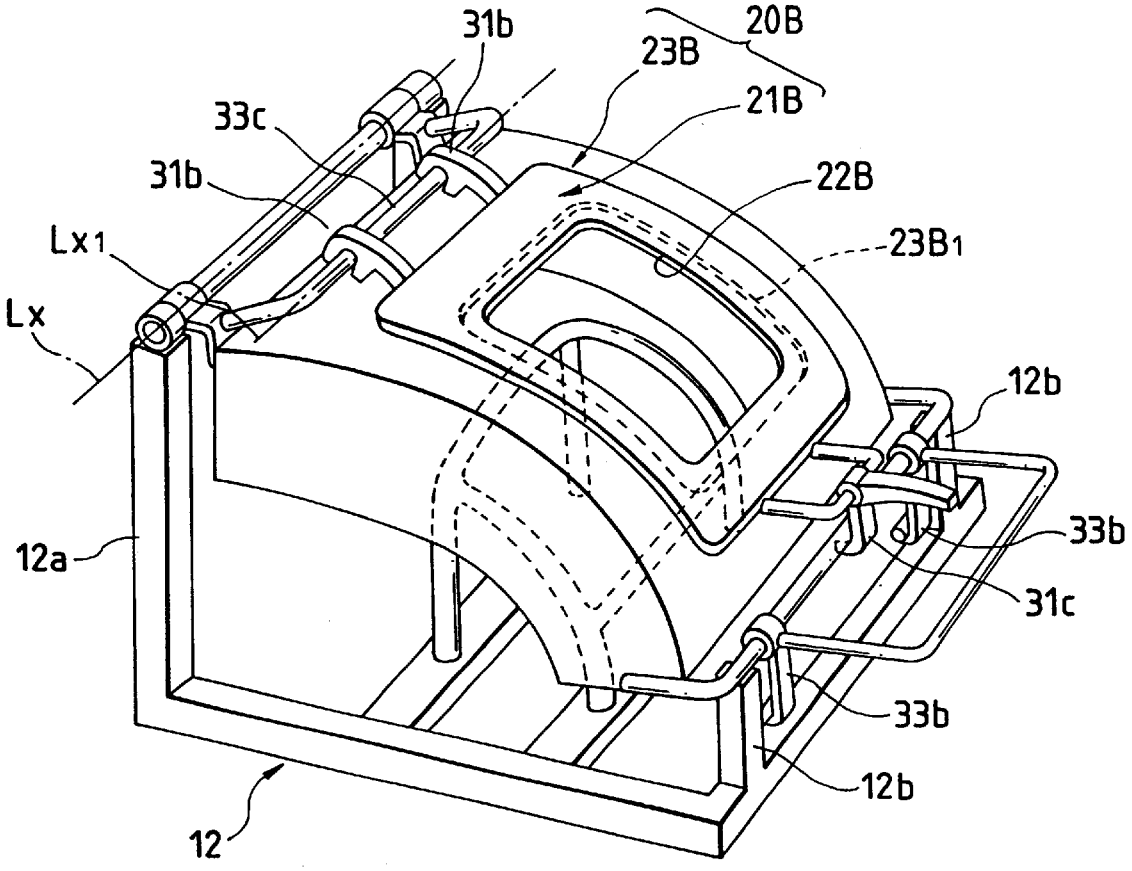
FIG. 8 is a vertical cross-sectional view of a third embodiment of a coating mask device of the invention for a lighting device.
Figure 9:
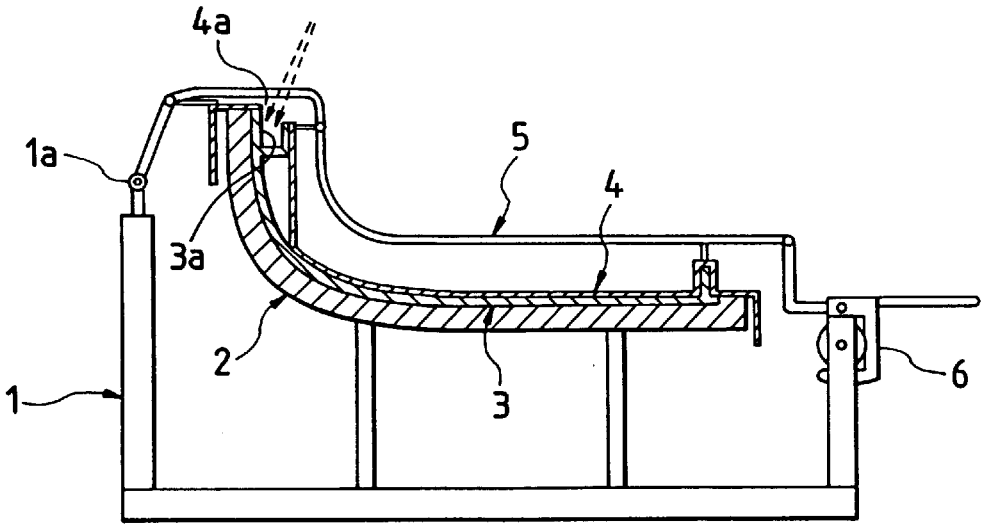
FIG. 9 PRIOR ART
FIG. 9 is a vertical cross-sectional view showing the overall construction of a conventional coating mask device for a lighting device.
Figure 10:
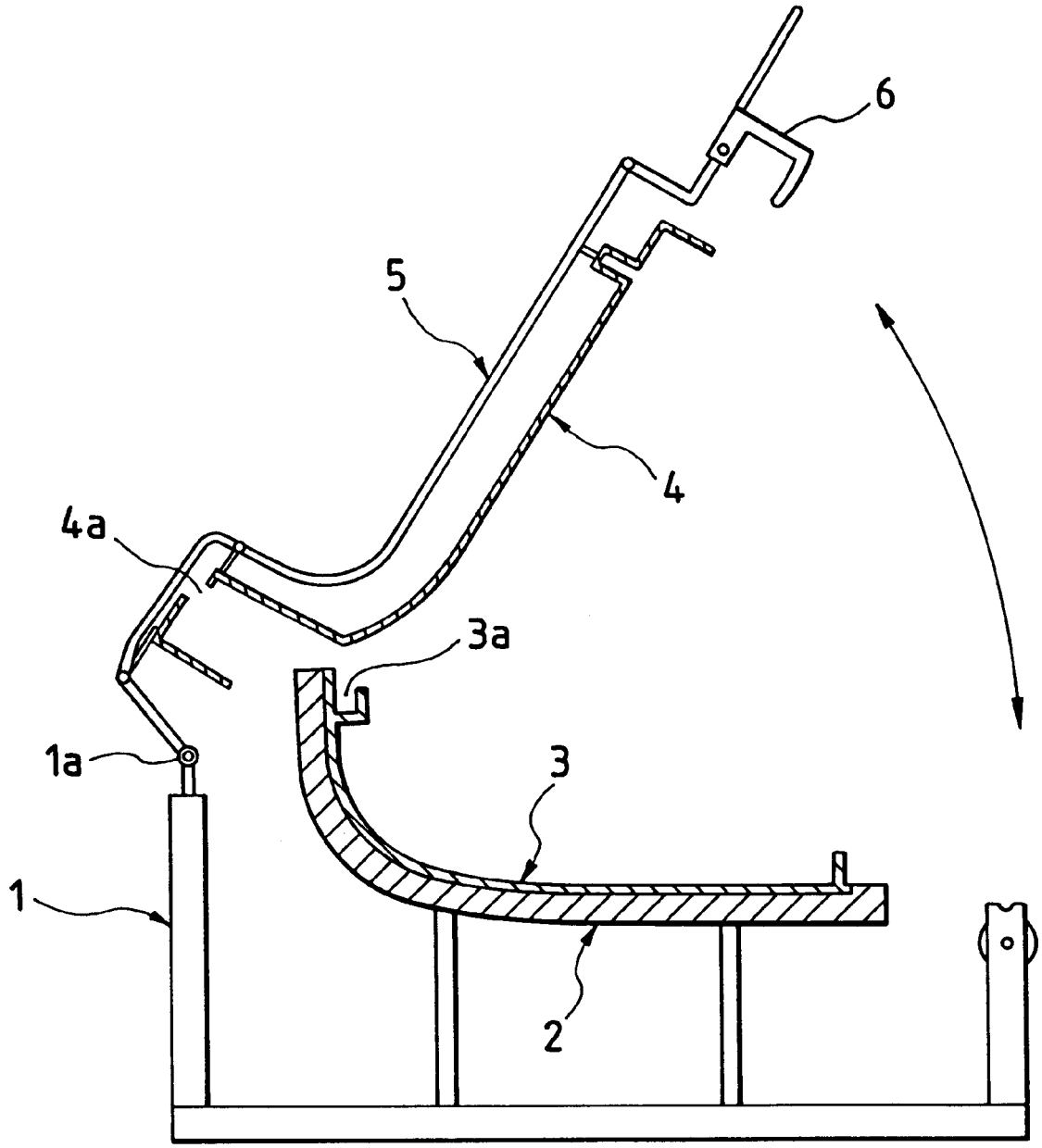
FIG. 10 PRIOR ART
FIG. 10 is a vertical cross-sectional view of the conventional coating mask device showing a mask body in its open condition.

FIG. 8 is a perspective view of a third embodiment of a coating mask device of the invention for a lighting device.

In the first and second embodiments, the coating is applied to part of the lens 14. However, in this third embodiment, a reflecting coating is applied to a reflector-forming region of a lamp body.

More specifically, a mask body 20B is divided into a main mask 23B and a partial mask 21B, and the main mask 23B is formed into such a size as to cover the outer periphery of the lamp body (not shown) (a component part of the lighting device), and has an opening 23B1 which is a size larger than the reflector region at the inner periphery of the lamp body, and the partial mask 21B has an opening 22B corresponding to the reflector-forming region (not shown) at the inner periphery of the lamp body.

The other construction of this embodiment is identical to that of the second embodiment, and these portions will be designated by identical reference numerals, respectively, and an explanation thereof will be omitted.

As is clear from the above description, the coating mask devices of the present invention achieve the following effects.

First, the partial mask is small in size, and, therefore, the mask body can be formed easily, thereby reducing costs.

Second, the partial mask is compact and lightweight, and, therefore, can be easily handled; and the exchanging of the mask, as well as the cleaning of the mask, can be effected smoothly.

Third, many partial masks can be put into the cleaning cage and cleaned at a the same time, and, therefore, the efficiency of the cleaning operation is high, and the amount of cleaning liquid required is less.

Fourth, if a portion of the lighting device component part, corresponding to the main mask or the partial mask, is changed in design, it is only necessary to modify the corresponding mask, and the other mask does not need to be modified. Therefore, the design change can be rapidly dealt with.

According to an embodiment of the present invention, the coating material will not adhere to that portion of the lighting device component part corresponding to the joined portion of the mask body, and, therefore, the coating can be applied only to the predetermined coat-forming region of the lighting device.

According to another embodiment of the present invention, the opening in the mask can be positioned relative to the coat-forming region of the lighting device with little error, and, therefore, the coating can be accurately applied only to the predetermined coat-forming region of the lighting device.

According to yet another embodiment of the present invention, the horizontal axis of pivotal movement of the partial mask and the horizontal axis of pivotal movement of the main mask are the same. Therefore, the opening in the mask can be positioned relative to the coat-forming region of the lighting device with a little error, allowing the coating to be accurately applied to only the predetermined coat-forming region of the lighting device. Additionally, the two masks can be easily designed.

What is claimed is:

1. A coating mask device for a lighting device comprising:

a support jig on which a component part of the lighting device can be placed;

a mask body arranged so as to cover the lighting device component part placed on said support jig, said mask body having an opening corresponding to a coat-forming region of the lighting device component part; and a frame for attaching to said mask body, wherein said mask body is divided into a partial mask having said opening, and a main mask for covering a region of the lighting device component part other than a region covered by said partial mask, and wherein said partial mask is removable from said main mask, and wherein said frame is divided into a partial frame integrally attached to said partial mask, and a main frame integrally attached to said main mask.

2. The coating mask device for a lighting device according to claim 1, wherein said partial mask and said main mask each include a joining portion and said partial mask and said main mask overlap each other at said joining portions.

3. The coating mask device for a lighting device according to claim 2, wherein said support jig is supported on a support base, and wherein each of said partial mask and said main mask is pivotally movable upwardly and downwardly, via said partial frame and said main frame, respectively, about a respective horizontal axis located at said support base so as to be opened and closed relative to said support jig.

4. The coating mask device for a lighting device according to claim 3, wherein the horizontal axis of pivotal movement of said partial mask and the horizontal axis of pivotal movement of said main mask are the same.

5. The coating mask device for a lighting device according to claim 3, wherein said partial mask is disposed at a side of said support jig nearest the horizontal axis of pivotal movement of said main mask.

6. The coating mask device for a lighting device according to claim 1, wherein said support jig is supported on a support base, and wherein each of said partial mask and said main mask is pivotally movable upwardly and downwardly, via said partial frame and said main frame, respectively, about a respective horizontal axis located at said support base so as to be opened and closed relative to said support jig.

7. The coating mask device for a lighting device according to claim 6, wherein the horizontal axis of pivotal movement of said partial mask and the horizontal axis of pivotal movement of said main mask are the same.

8. The coating mask device for a lighting device according to claim 6, wherein said partial mask is disposed at a side of said support jig nearest the horizontal axis of pivotal movement of said main mask.

* * * * *